United States Patent [19]

Rooklyn

[11] 4,416,202

[45] Nov. 22, 1983

[54] CONVEYOR BENCH/WORK STATION WITH SHUNT

[75] Inventor: Jack Rooklyn, Northridge, Calif.

[73] Assignee: Industrial Management Co., Chatsworth, Calif.

[21] Appl. No.: 263,773

[22] Filed: May 15, 1981

[51] Int. Cl.[3] ..... B61J 1/00

[52] U.S. Cl. ..... 104/88; 104/35; 104/130; 104/247

[58] Field of Search ..... 104/48, 88, 130, 247, 104/35; 193/38, 39, 41

[56] References Cited

U.S. PATENT DOCUMENTS

| | | | |
|---|---|---|---|
| 1,647,665 | 11/1927 | Riche | 193/38 |
| 2,469,575 | 5/1949 | Ralston | 104/247 UX |
| 2,633,809 | 4/1953 | Robinson et al. | 104/48 |
| 2,943,579 | 7/1960 | Geddes | 104/130 X |
| 3,356,039 | 12/1967 | Fonden et al. | 104/130 |
| 3,972,293 | 8/1976 | Watts . | |

*Primary Examiner*—E. R. Kazenske
*Assistant Examiner*—Douglas D. Watts
*Attorney, Agent, or Firm*—Herzig & Walsh, Inc.

[57] ABSTRACT

The invention is an improvement in mechanisms or apparatus for transporting articles or products between points such as work stations in an industrial plant or the like. A track or trackway is provided running between different points or work stations, the track provides fixed rail members. A truck or trolley equipped with rollers on its underside is movable on the trackway between different points or work stations, the trackway being supported at spaced intervals. The truck or trolley is provided with wheels or rollers that are engageable with the track. The truck or trolley is provided with additional wheels positioned so that the truck can move at right angles to the track into a shunt position at a particular work station. Articles such as devices being produced can thus be very readily moved about from one point to another, that is, from one work station to another in a plant area. The trucks or trolleys carrying parts can be moved directly by way of the shunts from the main track onto or over a bench or work station platform.

4 Claims, 5 Drawing Figures

CONVEYOR BENCH/WORK STATION WITH SHUNT

BACKGROUND OF THE INVENTION

1. Field of the Invention

The field of the invention is related to that of conveyors, the invention is an apparatus which includes means forming a trackway with a truck or trolley that moves on the trackway that can move from one point or work station in a plant or the like to another.

2. Description of the Prior Art

Conveyor systems of various types are well known in the prior art. One typical type of conveyor system often found in industrial plants is a type wherein there is provided a conveyor means mounted on uprights or standards and embodying relatively closely spaced transverse elongated rollers. The rollers are rotatable about transverse axles provided by shafts or arbors supported by the conveyor means. In using this type of system, the article, for example, in an industrial plant or other place must be lifted and placed on the transverse rollers of the conveyor system and then pushed along with the rollers rotating on their axis.

In using the system as described, articles, such as parts being worked on, can be moved from one point to another. However, initially the parts or articles must be lifted and placed onto the conveyor and pushed along the conveyor rollers to the desired further position or work station and then the parts must be, again, lifted and transferred by hand to a work bench or work station adjacent to the conveyor means. As can readily be seen, the use of this type of conveyor requires considerable manual effort on the part of the users; requires bending over and lifting both onto the conveyor and when taking the parts off to move them and place them on a work bench or work station. Lifting of heavy parts frequently results in injury to a worker.

A particular deficiency of the type of system described in the foregoing is that it is lacking in any means or facility for moving or transferring an article from the conveyor system off of it or, that is, in a lateral direction. As, for example, at right angles to the conveyor system to the surface of the work bench or platform.

The invention as described in detail hereinafter is intended to provide a system that overcomes all of the deficiencies and disadvantages of the prior art systems and to provide an improved system having capabilities not present in any known prior art system.

SUMMARY OF THE INVENTION

A preferred form of the invention is described briefly in the abstract.

In a preferred exemplary form of the invention, it is adapted for use in an industrial plant to facilitate movement of parts as, for example, from an area in the plant where they are initially fabricated and then must be moved or transferred to one or more other points or work stations where further work is done on the parts. In the preferred form the invention takes the form of a track means supported by appropriate uprights or standards and running between appropriate positions or stations in the overall work area. Preferably the transfer or transport means takes the form of flat, joined elements with side flanges or side members forming rails.

Associated with the conveyor trackway as described in the foregoing are one or more trucks or trolleys. Preferably these may take the form of flat, square or rectangular platforms equipped with wheels or rollers so that the truck can roll along the trackway with the wheels on the truck riding inside of the rails on the trackway.

A particular feature of the system is, in addition to the system having the capability of the trucks being able to travel along the conveyor trackway in either direction, shunts are provided whereby at any particular work place or work station the truck can be moved laterally with respect to the trackway onto or over a work station. To achieve this capability each truck is provided on its underside with additional pairs of wheels whereby the trucks or trolleys can move laterally at right angles. Structural means are provided to accommodate this type of movement. A typical work station may take the form of a platform or bench adjacent to a side of the conveyor means, that is, the track means at a particular point. At that point a gap is provided in the rail at one side of the trackway. Also, shunt guide members are provided on the bottom of the trackway member at that position so that at that position the additional rollers on the truck allow the truck to be moved laterally at right angles through the gap in the rail at that side of the trackway means into a position directly over the work station platform or flush with its surface, if desired. Parts can then be removed very readily from the truck onto the fixed surface of the platform of the work station and the truck can then be moved back onto the main trackway and, again, readily moved in either direction on it and back to an initial starting point, if desired. The construction of the trackway is such that it can readily be made to provide for changes in direction, such as right-angle changes by way of a rounded corner or otherwise.

Additionally, trackway means is readily adaptable to the provision of switching means for switching off the trackway to right or left onto a side track. Also, there can be more than one trackway which intersect at crossings or crossovers which have the capability of allowing the trucks to pass the crossovers without difficulty or interference. Changes in direction of the trackway in any amount can readily be facilitated whether changes of 90°, 45°, or any other amount.

In the light of the foregoing, the primary object of the invention is to make available an improved transport means particularly adaptable for use within an industrial plant or the like whereby parts can conveniently be moved or transported from one work place or work station to another.

A further object of the invention is to make available a system as referred to in the foregoing object wherein a trackway is provided having side rails and having trucks or trolleys equipped with wheels or rollers which can travel on the trackways from one station to another, the trackways being provided with shunts, that is, track means whereby trucks can move laterally, that is, at right angles to the trackway onto a position at or over a work station or work platform adjacent to a particular point along the trackway.

A further object is to realize a system having capabilities as identified in the foregoing whereby the trackway can be constructed to provide for changes in direction, for example, 90° or 45° or otherwise.

A further object is to realize a system as in the foregoing provided with side tracks equipped with switch means whereby a truck can readily be switched off onto a side track either ring or left.

Another object is to realize a system as in the foregoing wherein the system is provided with crossovers with tracks crossing or intersecting each other at right angles and constructed to allow tracks to pass such intersections or crossovers without interference.

A further object is to realize a system as in the foregoing including turntable means whereby a truck can readily be changed or turned from travel along one part of a trackway to a right angle trackway.

Further objects and additional advantages of the invention will become apparent from the following description and annexed drawings.

DESCRIPTION OF THE PREFERRED EMBODIMENT AND BEST MODE OF PRACTICE OF THE INVENTION

Figure 1:
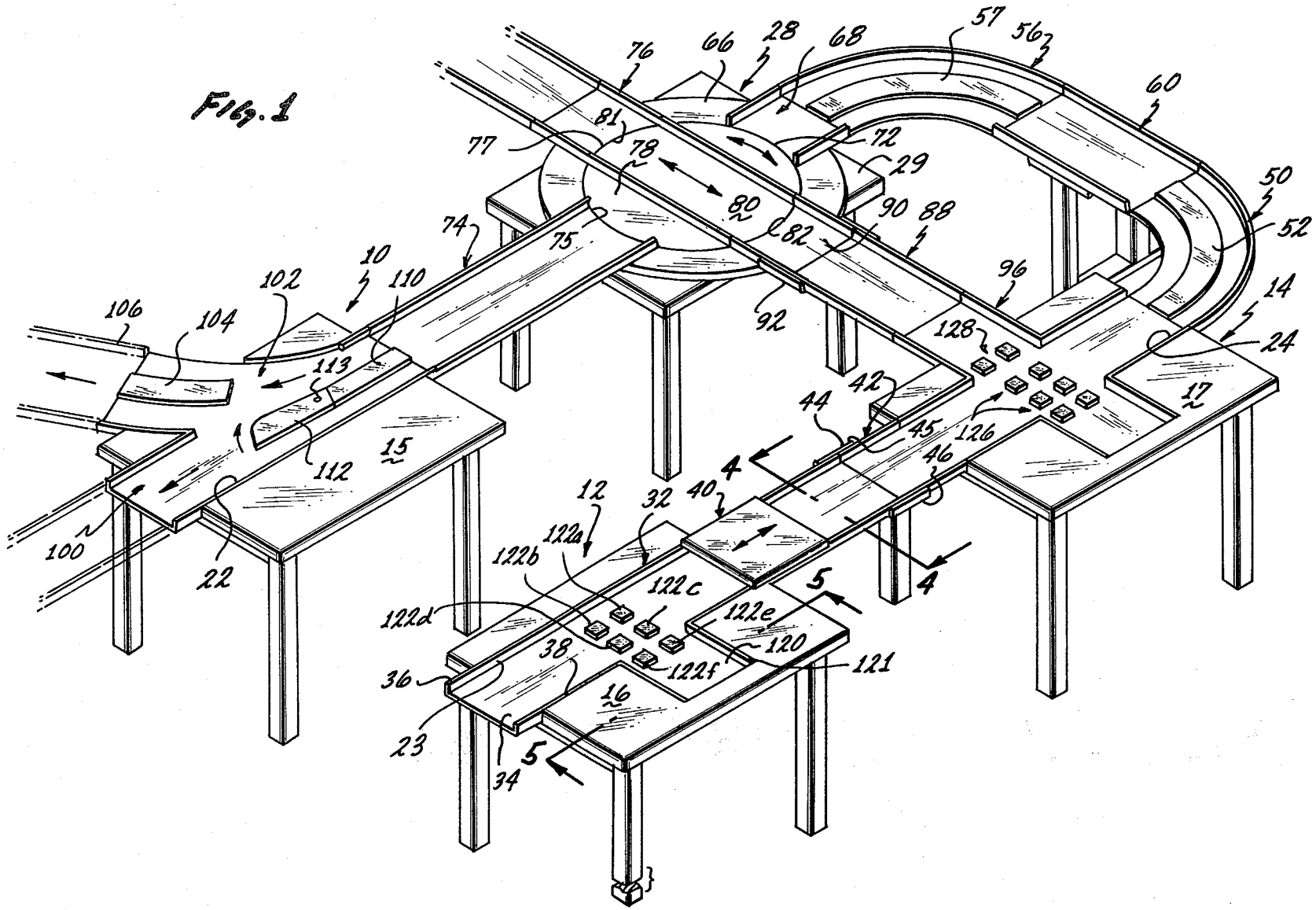
FIG. 1 is an isometric view of a preferred form of the system of the invention.

FIG. 1 is an illustrative view of a preferred form of track arrangement illustrating work stations, shunts to work stations, and a turntable. FIGS. 2–5 illustrate a preferred exemplary form of truck that is movable on the trackway and by way of shunts to the work stations.

Referring to FIG. 1, numerals 10, 12, and 14 illustrate work stations. As shown, these work stations are in the form of tables having work surfaces as designated at 15, 16, and 17, each having four legs. As shown, the work stations are in the form of tables. Referring to the station 10, the work surface 15 has a cutout portion or way in its surface as designated at 22 to receive the track or trackway. The surfaces 16 and 17 have similar recesses or ways as designated at 23 and 24 to receive the trackway.

Numeral 28 designates another station which is in the form of a table having four legs and a surface as designated at 29, which supports a turntable provided in the trackway which will be described more in detail presently.

The trackway is constructed in sections which can be spliced together. Curved sections of trackway are provided as shown so that the entire system can be built in various desired configurations in order to accommodate work stations located in any particular arrangement or pattern.

Referring to the station 12, numeral 32 designates a section of track or trackway. The trackway may be formed of any suitable material including metal, plastic, or otherwise. The section 32 has a flat bottom surface 34 and side flanges 36 and 38 which form rails. Numeral 40 designates a truck which is movable along the trackway and which will be described in detail presently.

Numeral 42 designates another similar section of trackway connecting to the work station 14, the sections being spliced together by way of a splicing means 44 which has side flanges 45 and 46. This member fits underneath a joint between the sections 32 and 42 with its side flanges 45 and 46 engaging the side rails of the track sections.

Numeral 50 designates a further section of trackway which is curved through 90°. This section has a central or intermediate raised member 52, the top surface of which is level with the rails at the sides of the section 50 and the purpose of which will be described presently.

Numeral 56 designates another curved section of track or trackway which is curved through 90° for a 90° turn in the opposite direction. This section has raised intermediate part 57, the top surface of which is level with the side rails.

Numeral 60 designates a short section of trackway which is straight and which joins the two curved sections 50 and 56.

The station 28, which is a turntable station, has a flat ring member 66 mounted on it. Mounted on it is a short section of trackway 68 to which the curved section 56 joins, the inner edge of the track section 68 being arcuate as designated at 72. Numeral 74 designates another section of trackway, the end of which is mounted on the ring member 66 and the inner end of which is curved as shown at 75. Within the center of the ring member 66 is a round platform 78 which forms a turntable. Carried on it is a section of track 80 having side rails like the other sections of track, the ends of it being arcuate as shown at 81 and 82 conform to the inside of the ring member 60 and the arcuate ends 72 and 75 of the track sections 68 and 74, respectively. Numeral 76 designates another section of trackway normal to the sections 68 and 74, its end being arcuate as shown at 77 to conform to the periphery of platform 78.

The section of track 74 provides a connecting track or trackway from the turntable station 28 to the work station 10. A branch track or trackway to the work station 14 is provided. Numeral 88 designates an intermediate section of trackway. Numeral 90 designates a section of the trackway mounted on the ring 66 and having an inner arcuate inner edge comformable to the circumference of the rotary member 78. The sections 88 and 90 are joined by a splice member 92.

Numeral 96 designates a track section extending at right angles, that is, normally to the track section 42 and the work station 14 to accommodate a transfer of the movable truck which will be described, from the turntable station 28 to the work station 14.

The work station 10 supports a track section 100 as may be seen in FIG. 1. This track section has a branch track section part 102 which is curved to provide a shunt or side track from the track 74. The section 102 is like the curved sections 50 and 56 having an intermediate raised member 104, the purpose of which will be described more in detail presently. The end of the curved section 102 is shown connecting to another straight section of track as designated at 106.

The track section 100 at one end has an intermediate raised portion 110 as shown, which will be described more in detail presently. At one end of the portion 110 is a similar section 112 which is pivotally mounted at 113 so that it can be moved from a position in line with the portion 110 to engage with an end of the portion 104. The purpose of this construction will be described more in detail presently in connection with the description of the truck that moves on the trackway.

Referring again to the station 12, the working surface 16 has a further recess or cutout 120 in its surface for track section 121 which is positioned normal to the recess 23, the working surface 16 being closely adjacent to, that is, juxtaposed to the track section 32. Upstanding from the bottom surface 34 of the track sections 32 and 120 are a group of six upstanding square portions 122*a, b, c, d*, and *e*, spaced from each other as shown, along the length of track section 32 and also laterally thereof. The purpose of these portions will be described more in detail presently in connection with the description of the truck 40. A similar group of raised portions is designated at 126 formed in the track section 42, that is, at the work station 14 and numeral 128 designates two more of such raised portions positioned at the end of the right angle or normal track section 96.

Figure 2:
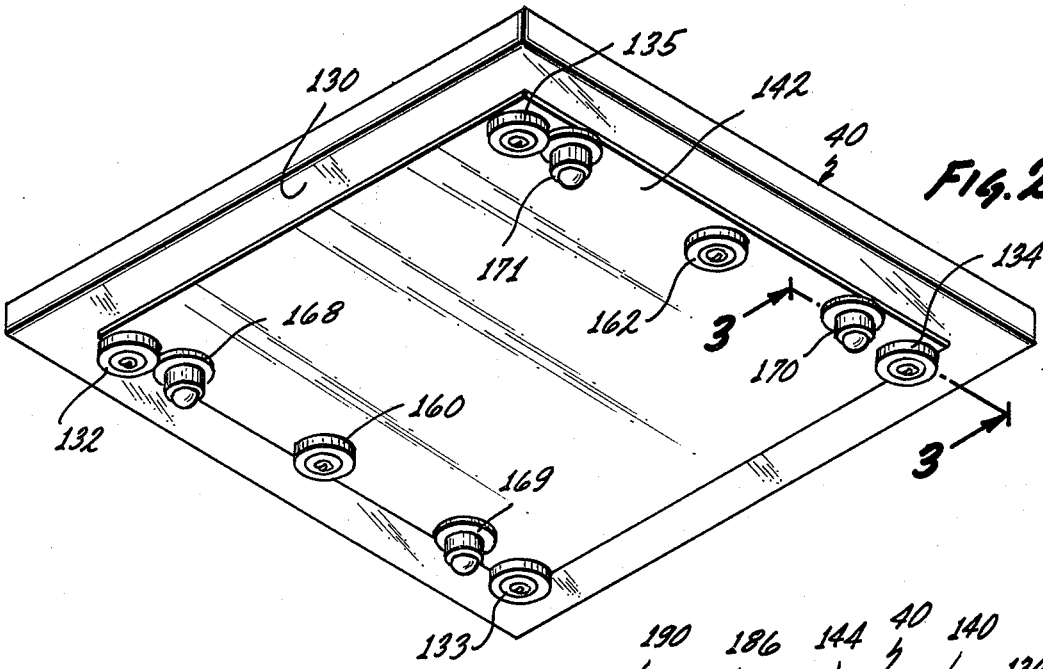
FIG. 2 is an isometric view of the underside of the truck showing its support and a guide rotatable members.
Figure 3:
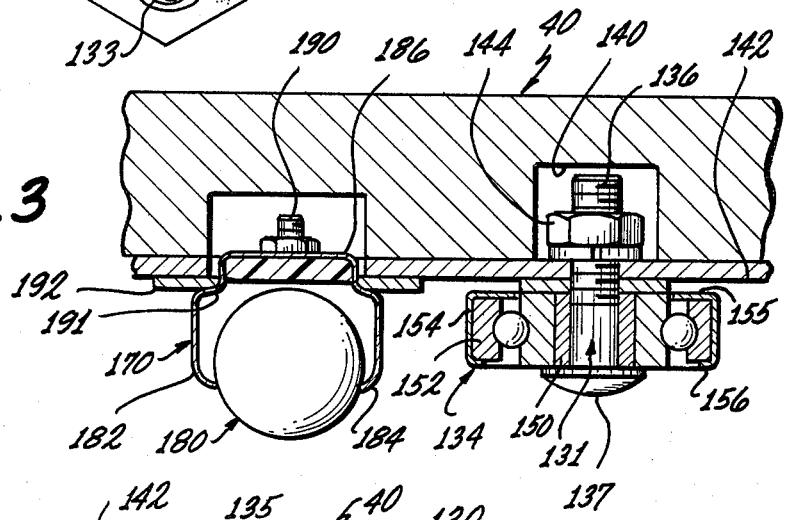
FIG. 3 is a sectional view taken along the line 3—3 of FIG. 2.

FIG. 2 is a detail view of the underside of a preferred exemplary form of the truck 40. In a preferred form it is square as shown. It has a flat-topped surface as may be seen in FIG. 1. It may be constructed of any suitable material including plastic, metal, or composition material. On the underside around the edges is a continuous rib as designated at 130.

Supported on the underside of the truck 40 is a group of six guide rollers or wheels. Four of these are adjacent to the corners as designated at 132, 133, 134, and 135. The roller 134 and its mounting are shown in cross section in FIG. 3. The roller is mounted on the shank 135 of a bolt 136 having a head 137. Numeral 140 designates a cutout in the underside of the material of the truck 40 into which the end of the bolt 136 extends, the bolt extending through a panel 142 of suitable material on the bottom of the truck 40. Numeral 144 designates a nut on the bolt. Mounted on the shank 135 of the bolt 136 is a bushing 150 and numeral 152 designates a ball bearing surrounding the bushing, the roller or wheel member 134 having an outer peripheral surface 154 as shown and side flanges 155 and 156 within which the ball bearing is received.

All of the roller members or guide wheels 132–135 are alike, so they need not be described in further detail.

A further pair of similar guide rollers or wheels is provided as designated at 160 and 162 which are like the previously described guide wheels. The guide wheels 160 and 162 are mounted opposite each other at opposite sides of the truck 40 but spaced inwardly slightly farther for a purpose as will be described.

Rotatable support members are provided for the truck 40 which are of caster type so as to allow the truck 40 to be supported on them and to be moved on trackway portions which extend at an angle or which are curved. Four of such support casters are provided and are positioned as shown in FIG. 2 being identified by the numerals 168, 169, 170, and 171. The rotatable support device or caster 170 is shown in detail in FIG. 3. Numeral 180 designates a ball of a ball caster which may be made of any suitable material such as metal. The ball is carried in a cage as designated at 182 which is circular having an inwardly curved bottom edge 184 which engages and holds the ball 180. The lower part of the cage 182 is in the form of a skirt extending from an upper cylindrical part 186. The cage and its upper part are secured to the panel 142 by way of a bolt as designated at 190. The flat upper part 186 is of smaller diameter providing a circular shoulder 191 between the skirt part of the cage and smaller upper part. Numeral 192 designates a spacer positioned between the shoulder 190 and the panel 142. The caster members 168–171 as stated provide a support for the truck 40 allowing it to move in any direction so that the trackway can be directed in any direction including a side track direction which is normal to the main track.

Figure 4:
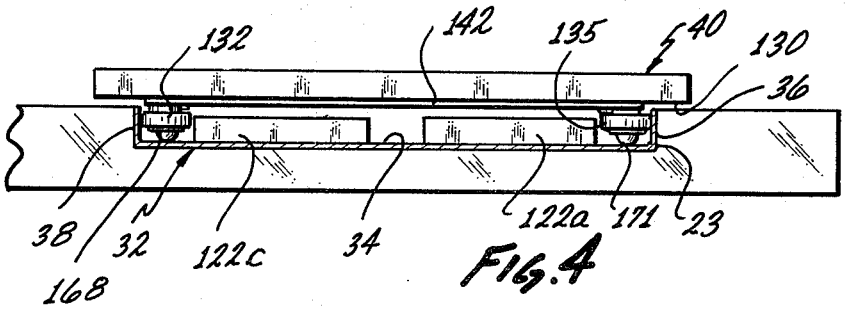
FIG. 4 is a sectional view taken along the line of 4—4 of FIG. 1.

FIG. 1 shows a truck 40 positioned to ride on the trackway. The guide rollers 132–135 come into position as shown in FIG. 4 in which these rollers or wheels, being mounted on vertical axes engage the side flanges or rails 36 and 38 at the sides of the trackway.

The intermediate raised portions or surfaces 122 previously referred to provide structure whereby the truck may be sidetracked, that is, shunted from the main trackway portion to a shunt or side trackway portion enabling the truck to be moved normally from the main trackway directly to the table surface of a work station, as may be seen at 12 in FIG. 1.

Figure 5:
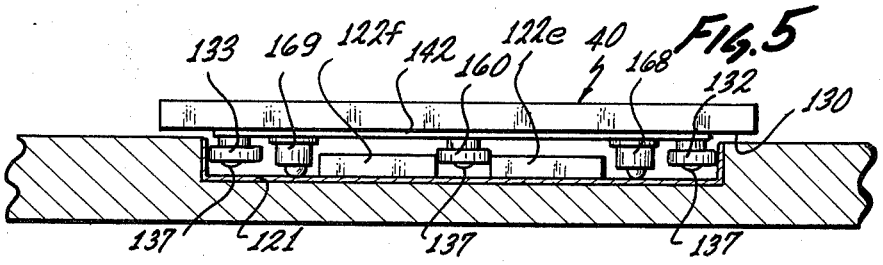
FIG. 5 is a sectional view taken along the line 5—5 of FIG. 1.

FIG. 5 shows the relationship of the guide rollers or guide wheels and support casters to the trackway when the truck is sidetracked or shunted from the main track to the side or shunt track 120 at the work station 12. As may be seen in FIG. 1, there is a space between the raised portions 122*a* and 122*c* and between portions 122*b* and 122*d* to allow the guide wheels 160 and 162 to pass between them if the truck is to be moved along the trackway without being sidetracked or shunted off. A similar space is provided between the raised portions 122*e* and 122*f*. Thus, as may be seen from FIG. 5, truck 40 can be moved to a position on trackway 32 that is directly opposite to the trackway portion 121 at the work station 12, so the truck can be shunted, that is, be moved directly normal to the trackway portion 32 onto the side trackway portion 121 of the station 12. During this movement the intermediate guide wheels or rollers 160 and 162 are engaged between and guided between the raised portions 122*a–f*. As the truck moves into the shunt trackway, the side guide wheels 132–135 are guided by the side rails of the trackway as already described in connection with the main trackway so that the truck moves accurately in a normal direction into the shunt in the top surface 16 of station 12.

From the foregoing it will be observed that at all times the truck 40 is supported on the caster means 168–171 so that the truck can move along the trackway or can be sidetracked or shunted to a work station or in any other direction.

The trackway can be constructed in any desired configuration as a conveyor system to accommodate any arrangement of work stations in a plant area of the like.

If desired, there may be a plurality of turntable stations like the station 28. As can be observed, the truck can be moved onto the track section 80 that is carried by the turntable platform 78 which can then be turned so that the truck can be directed to any of the other track sections 74, 76, or 88.

At the station 10, another form of shunt or side track is shown with a switch mechanism so that the truck can either proceed in the direction of the track sections 74 and 100 or onto the side track 106. Member 112 is a switch member which can be moved to its other position aligned with the raised portion 104 to cause the truck to move onto the side track, the intermediate guide rollers 160 and 162 engaging the sides of the raised portions 110 and the switch member 112, and the raised portion 104 to constrain the truck to move onto the side track. The guide rollers 160 and 162 cause this movement of the truck just as they do in cooperation with the raised portions 52 and 57 of the curved sections 50 and 56.

From the foregoing those skilled in the art will readily understand the nature of the invention and its utilization and the manner in which it achieves and realizes all of the objects set forth in the foregoing. The construction is simpler and more economical than that of conventionally known conveyor systems, the truck itself being of simplified construction. The movement of parts from one position to another is greatly facilitated as is the positioning of parts at a work station adjacent to the trackway.

The foregoing disclosure is representative of a preferred form of the invention and is to be interpreted in an illustrative rather than a limiting sense. Some alternatives and variations and equivalents in the construction of the trackways and the truck are possible. It is intended that the invention shall be accorded the full scope of the claims appended hereto.

What is claimed is:

1. In a conveyor system, in combination, means providing a trackway having a flat bottom and side flanges extending between a plurality of work stations where work pieces or parts are to be transferred between work stations a carrying truck movable along the trackway between work stations, the truck having supporting means provided by ball castors in fixed postions whereby the truck can move in different directions, the said truck having guide rollers at corners thereof on vertical axes positioned to engage the side flanges of the trackway, the trackway having portions including change in direction which can be tranversed by the truck, the trackway having guide elements at said portions, the truck having additional guide rollers on vertical axes at intermediate positions on two sides of the truck, positioned to engage said elements whereby the truck is positively guided while changing direction.

2. A system as in claim 1 wherein the trackway includes at least one side-track portion, the said trackway guide elements positioned for engagement with said additional guide rollers whereby the said truck can be moved from the trackway means onto the side-track portion, or past the said track portion being guided by said additional guide rollers and guide elements.

3. In a conveyor system, in combination, means providing a trackway having a flat bottom and side flanges extending between a plurality of work stations where work pieces or parts are to be transferred between work stations, a carrying truck movable along the trackway between work stations, the truck having supporting means provided by castors whereby the truck can move in different directions, the said truck having guide rollers on vertical axes positioned to engage the side flanges of the trackway, the trackway having portions including change in direction which can be traversed by the truck, the trackway includes at least one side-track portion, the side trackway means having upstanding guide elements positioned for engagement with certain of said guide rollers, whereby the said truck can be moved from the trackway means onto the said-track portion, being guided by said certain guide rollers and guide elements, said guide rollers include guide rollers positioned at corners of the truck, additional guide rollers at intermediate positions on two sides of the truck in a position to be guided by said guide elements of the trackway when the truck moves onto a side track portion.

4. A system as in claim 1, wherein the said guide elements include at least one moveable switching element which is moveable to accommodate movement of the truck onto one of the said portions, the additional guide rollers being guided by said switching element.

* * * * *